US008961072B2

(12) United States Patent
Thommesen

(10) Patent No.: US 8,961,072 B2
(45) Date of Patent: Feb. 24, 2015

(54) TENSION FRAME

(71) Applicant: Aker Oilfield Services Operation AS, Oslo (NO)

(72) Inventor: Steingrim Thommesen, Oslo (NO)

(73) Assignee: Aker Oilfield Services Operation AS, Oslo (NO)

( * ) Notice: Subject to any disclaimer, the term of this patent is extended or adjusted under 35 U.S.C. 154(b) by 0 days.

(21) Appl. No.: 13/911,744

(22) Filed: Jun. 6, 2013

(65) Prior Publication Data

US 2013/0330132 A1 Dec. 12, 2013

(30) Foreign Application Priority Data

Jun. 7, 2012 (NO) ..... 20120665

(51) Int. Cl.

| | |
|---|---|
| ***E21B 19/00*** | (2006.01) |
| ***E21B 15/02*** | (2006.01) |
| ***E21B 7/128*** | (2006.01) |
| ***E21B 33/072*** | (2006.01) |
| ***E21B 19/22*** | (2006.01) |

(52) U.S. Cl.

CPC ..... *E21B 7/128* (2013.01); *E21B 33/072* (2013.01); *E21B 19/22* (2013.01)

USPC ..... 405/224.4

(58) Field of Classification Search

USPC ..... 405/223.1, 224.2, 224.4

See application file for complete search history.

(56) References Cited

U.S. PATENT DOCUMENTS

| | | | | |
|---|---|---|---|---|
| 7,334,967 | B2 * | 2/2008 | Blakseth et al. | 405/224.2 |
| 7,658,228 | B2 * | 2/2010 | Moksvold | 405/224.4 |
| 8,079,426 | B2 * | 12/2011 | Petersson | 166/352 |
| 8,191,636 | B2 * | 6/2012 | Coles | 405/224.2 |
| 2005/0123358 | A1 * | 6/2005 | Blakseth et al. | 405/224.2 |
| 2005/0126790 | A1 | 6/2005 | Beato et al. | |
| 2006/0196671 | A1 | 9/2006 | Robichaux | |
| 2007/0089884 | A1 | 4/2007 | Patton | |
| 2012/0227976 | A1 | 9/2012 | Barone et al. | |

* cited by examiner

*Primary Examiner* — Frederick L Lagman

(74) *Attorney, Agent, or Firm* — Winstead PC

(57) ABSTRACT

A tension frame (2) for its application in a riser system for hydrocarbon exploration and production. The tension frame is (2) installed on a well control unit (5) atop at least one riser (9) in said riser system. The frame is adapted to receive a pressure control unit and hold it in line with the centre of the riser. The tension frame (2) houses at least two pre-installed pressure control equipment units (3, 4) of which one at a time is adapted to be hold at an active position, in which the unit is in line with the centre of the riser, and the other is adapted to be kept in a parked position within the frame.

8 Claims, 7 Drawing Sheets

TENSION FRAME

FIELD OF THE INVENTION

The present invention in general relates to a tension frame for its application with a riser system and in particular to a tension frame, which houses at least two pre-installed pressure control equipments for its application with a riser system for hydrocarbon exploration and production.

Particularly, the present invention relates to a tension frame according to the preamble of claim 1.

TECHNICAL BACKGROUND OF THE INVENTION

In riser systems for hydrocarbon exploration and production, such as in subsea operations from a vessel or exploration and production platform, coiled tubing and wire line operations, are common. These are applied for lowering equipments or measurement devices into the well or for pumping chemicals through the coil and various other operations.

Pressure control equipments are applied in coiled tubing and wire line operations for sealing around a coiled tubing or a wire line, while allowing the wire line or coiled tubing to pass down into the riser.

The riser is kept under proper tension by a tension system. This means that the vessel or platform is moving with the waves while the riser is kept substantially still. Consequently, there may be a substantive relative movement between the riser and the vessel.

A tension frame is deployed on top of the riser and is adapted to follow the movement of the riser. The tension frame is used for wire lining and coiled tubing operations into the riser. An example of a tension frame is shown in US 2005/0126790. US 2006/0196671 and US 2007/0089884 show other examples of a tension frame.

Conventionally, a tension frame is installed between a surface flow tree and a winch in the drilling or intervention tower. During wire line operations, wire line pressure control equipment is hoisted into the tension frame and connected to the top of the surface flow tree.

During coiled tubing operations, the coiled tubing pressure control equipment is lifted into the tension frame and connected to the top of the surface flow tree.

The above operations of lifting the pressure control equipment are time consuming and risky, having regard to the vertical relative motion between the tower and the riser with the tension frame.

Accordingly, there is a long felt need for a technology which ensures increased efficiency and faster as well as less complicated operation in respect of installation of pressure control equipments in tension frame during wire line and coiled tubing operations. There is also a need to avoid installing and de-installing of pressure control equipments up and down to the tension frame, on top of the surface flow tree, during such operations.

The present invention meets the abovementioned long felt need by providing a tension frame which houses at least two pressure control equipments pre-installed and parked in a ready-to-use state, one each for wire line and coiled tubing operations.

OBJECTS OF THE INVENTION

It is the prime object of the present invention to provide a tension frame for its application with a riser system in hydrocarbon exploration and production, which ensures increased efficiency and faster and less risky operations in respect of installation and de-installation of pressure control equipment, during wire line and coiled tubing operations.

It is yet another object of the present invention to provide a tension frame for its application with a riser system in hydrocarbon exploration and production, which avoids installing and de-installing of pressure control equipments up and down to the tension frame, on top of the well control unit such as a surface flow tree, during wire line and cabled tubing operations.

It is a further object of the present invention to provide a tension frame which ensures smooth and easy wire line and coiled tubing operations during hydrocarbon exploration and production.

All through the specification including the claims, the words "hydrocarbon", "riser", "tension frame", "riser system", "pressure control equipment", "well control unit", "tower", " tree or surface flow tree", are to be interpreted in the broadest sense of the respective terms and includes all similar items in the field known by other terms, as may be clear to persons skilled in the art. Restriction/limitation, if any, referred to in the specification, is solely by way of example and understanding the present invention.

SUMMARY OF THE INVENTION

According to a first aspect of the present invention there is provided a tension frame for its application in a riser system for hydrocarbon exploration and production. The tension frame is installed on a well control unit atop at least one riser in the riser system. According to the invention, the tension frame houses at least two pre-installed pressure control equipment units in ready to use state, one each for coiled tubing and wire line operations for activation of any one of the pressure control equipment units.

According to an advantageous embodiment of the first aspect of the present invention, the wire line pressure control equipment and coiled tubing pressure control equipment are parked inside the tension frame on either side of the riser center, immediately atop the well control unit.

According to another advantageous embodiment of the first aspect of the present invention in the event of activation of the wire line pressure control equipment along the riser centre for connection with the well control unit, the coiled tubing pressure control equipment is arranged to be parked inside the tension frame, on one side of said riser center.

According to a further advantageous embodiment of the first aspect of the present invention, in the event of activation of the coiled tubing pressure control equipment along the riser centre for connection with the well control unit, the wire line pressure control equipment is arranged to be parked inside the tension frame, on one side of said riser center.

Preferably, the tension frame is accessible by a lifting and lowering device for activating and parking the wire line pressure control equipment and the coiled tubing pressure control equipment.

According to a second aspect of the present invention there is provided a riser system for hydrocarbon exploration and production. The riser system comprises at least one riser extending from a well head to a drilling or intervention unit, a well control unit atop the riser and a tension frame installed on the well control unit. According to the invention, the tension frame of the riser system houses at least two pre-installed pressure control equipments in ready-to-use state, one each for coiled tubing and wire line operations, for activation of any one of said pressure control equipments.

BRIEF DESCRIPTION OF THE DRAWINGS

Having described the main features of the invention above, a more detailed and non-limiting description of a n exemplary embodiment will be given in the following with reference to the drawings.

DETAILED DESCRIPTION OF THE INVENTION

The following describes a preferred embodiment of the present invention and some relevant prior art which are purely exemplary for the sake of understanding the invention and non-limiting.

The present invention relates to well control equipment on or near the surface in conjunction with a high-pressure well intervention riser system from a drilling or intervention unit such as a vessel or a rig.

The present invention addresses the placement of pressure control equipment for cable and coiled tubing in a tension frame on a well control unit, such as a tree or a surface flow tree, on top of a high pressure riser.

Figure 1:
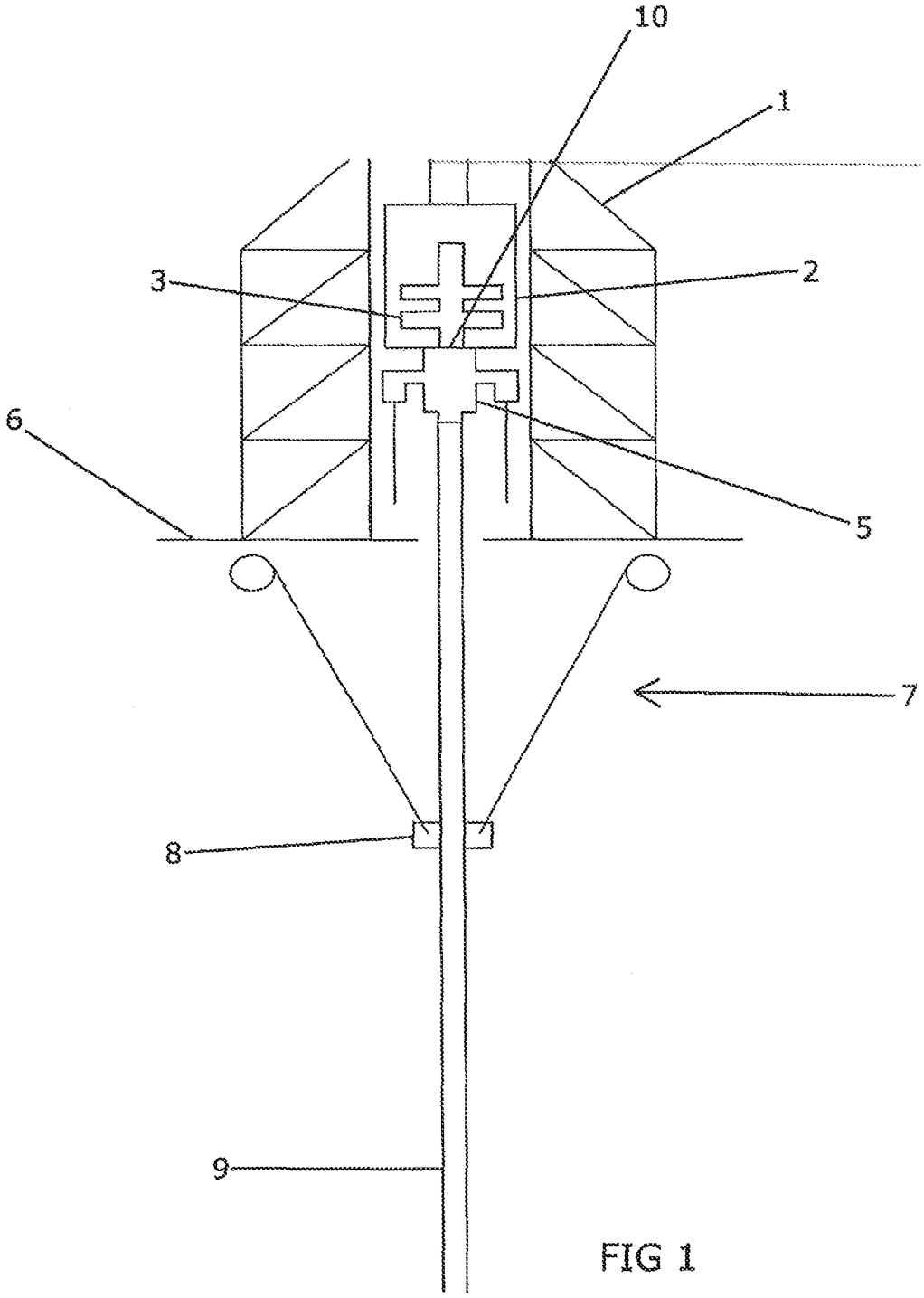
FIGS. 1 to 4 are front views of a riser system as known in prior art showing the different positions of the pressure control equipment units in a tension frame.

The invention will be further clear from the figures where like reference numerals represent like features As shown in FIG. 1 a tension frame 2 is conventionally installed between a tree 5 on top of a high pressure riser 9 and a winch (not shown) in the tower 1. The high pressure riser 9 extends from the seabed (not shown) to a drilling or intervention unit such as a vessel or a rig. The tensioning system 7 is connected between the deck 6 and an anchoring point 8 on the riser 9. It keeps the riser tensioned.

The tension frame 2 carries a well line pressure control equipment unit 3 lined up with the riser centre 10 atop the tree 5.

Figure 2:
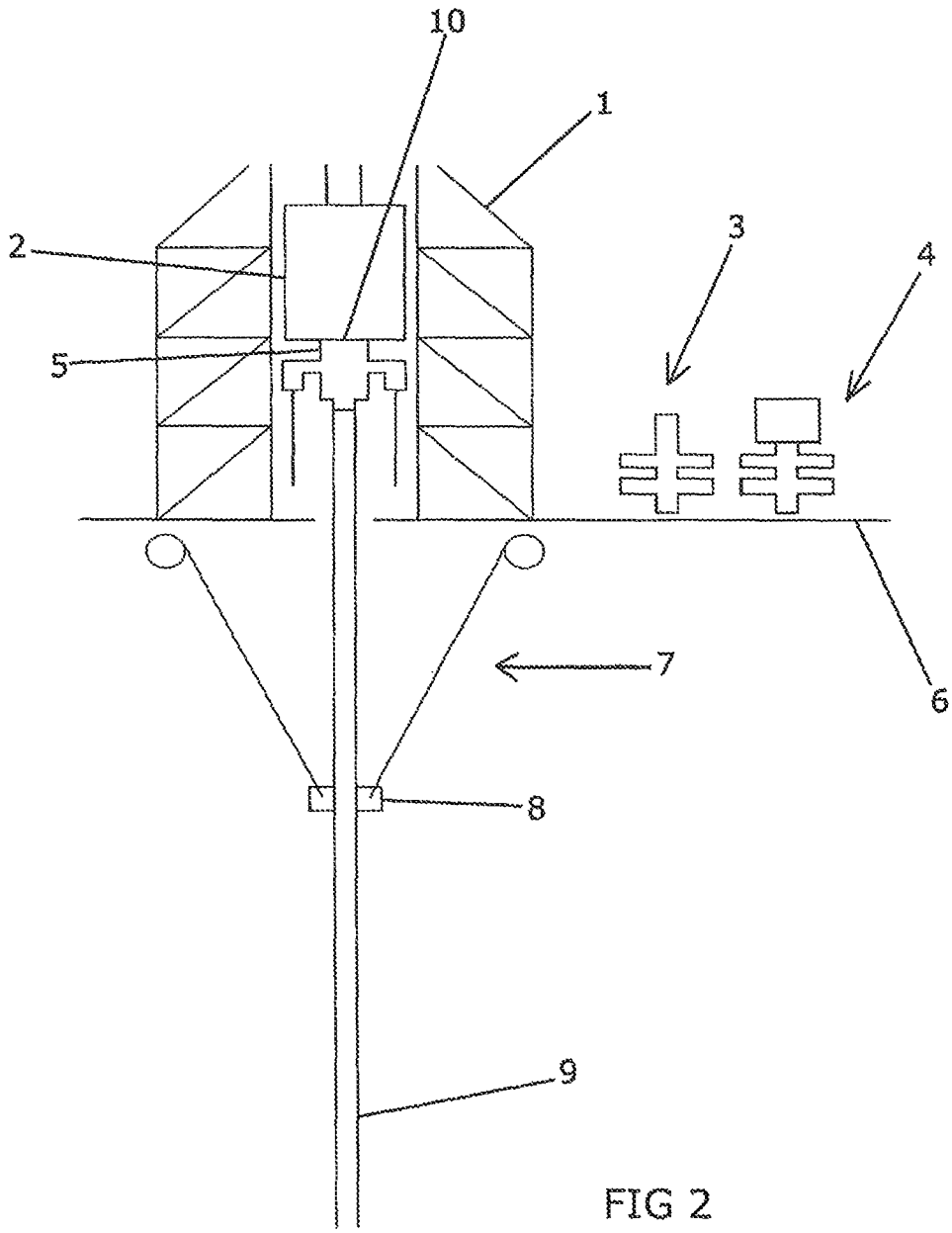

FIG. 2 is a view where the wire line pressure control equipment unit 3 and a coiled tubing equipment unit 4 are parked side by side on the deck 6 of the vessel or platform.

Figure 3:
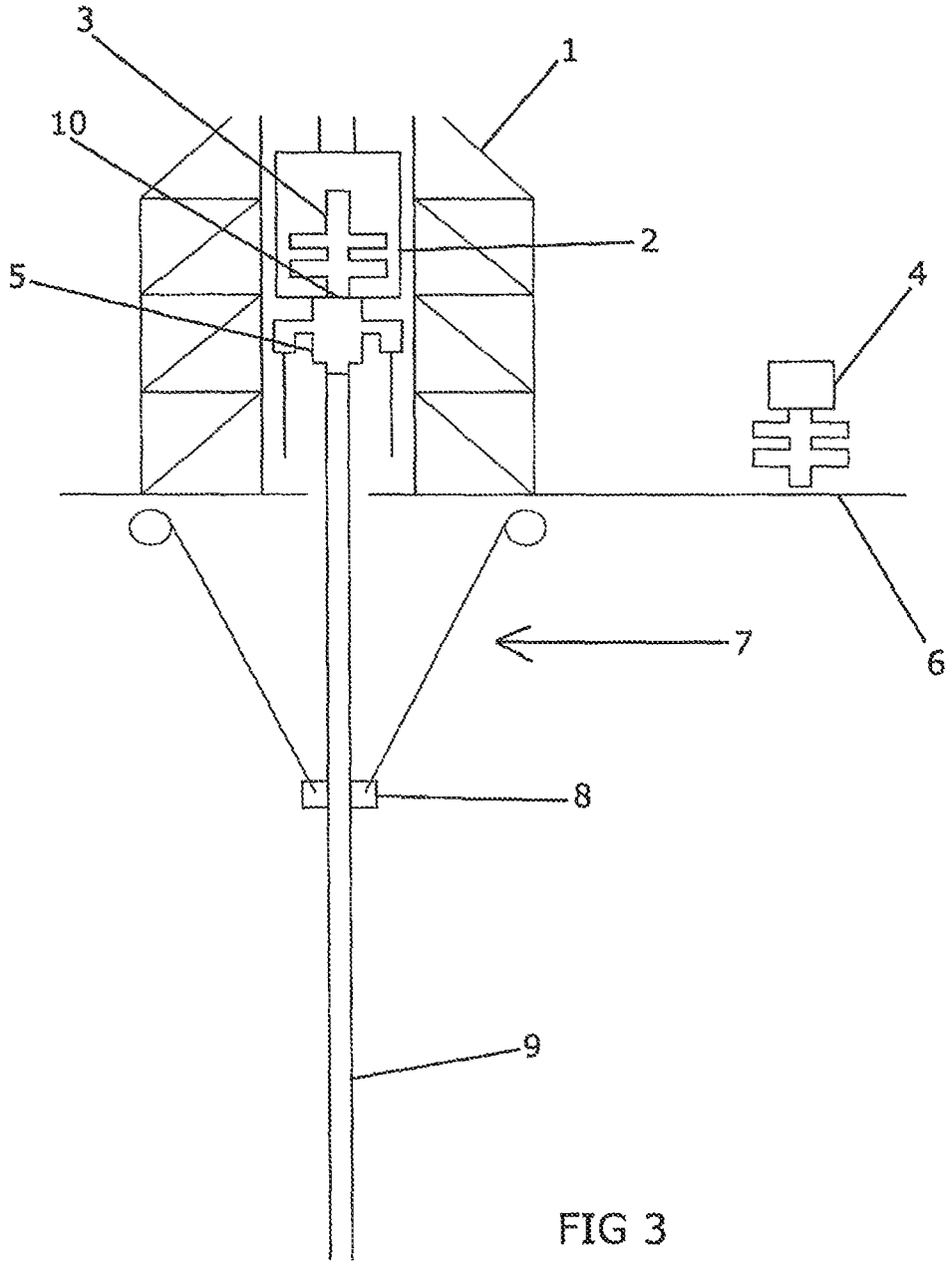

FIG. 3 is a view where the tension frame 2 has the wire line pressure control equipment 3 installed in line with the riser centre 10 atop the tree 5, while the coiled tubing pressure control equipment 4 is parked on the deck 6.

Figure 4:
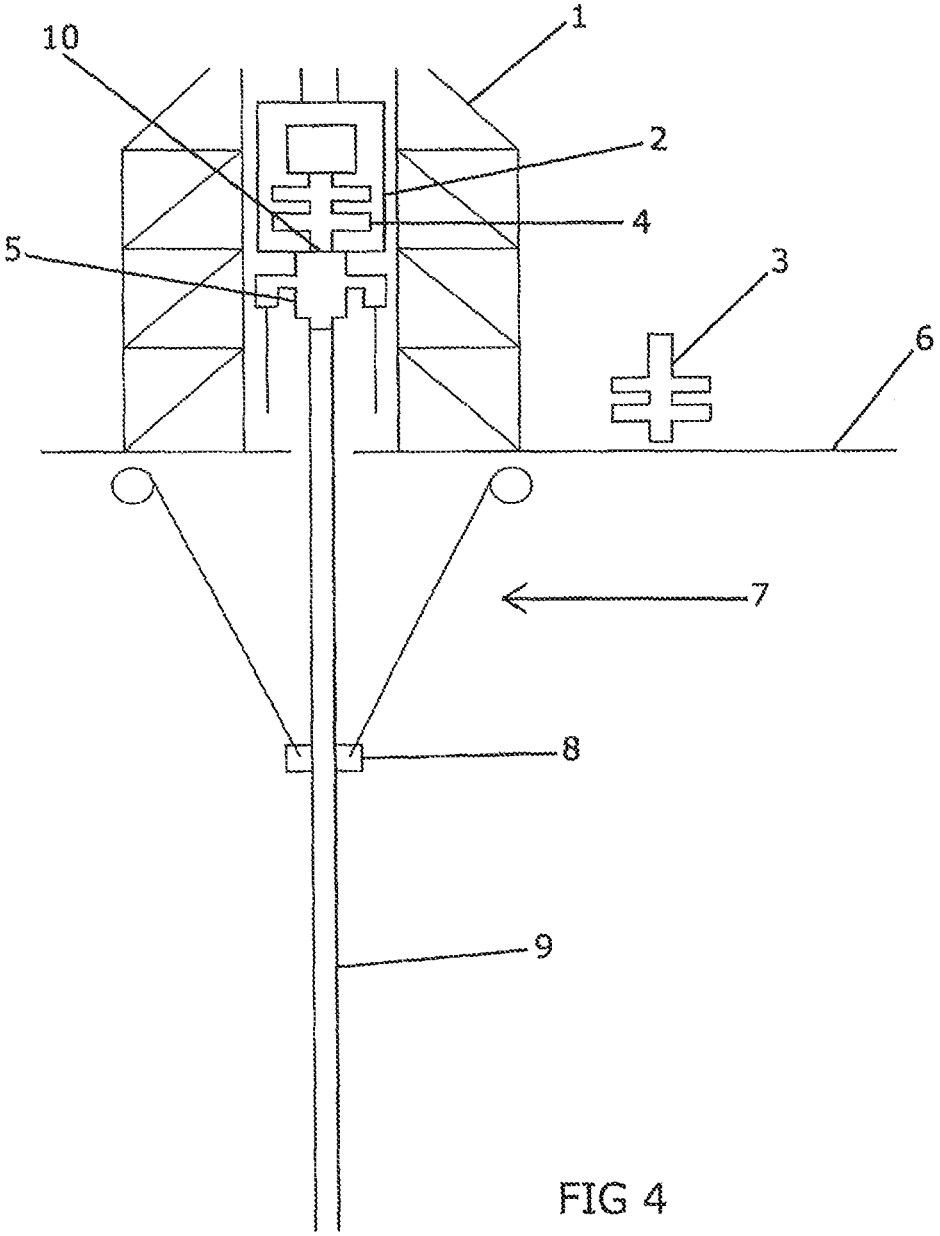

FIG. 4 is a view, where the positions of the pressure control equipment units have been interchanged from what is shown in FIG. 3. It is a view showing a tension frame 2 which has a coiled tubing pressure control equipment 4 installed in line with the riser center 10 atop the tree 5, while a wire line pressure control equipment 3 is parked on the deck 6.

All these FIGS. 1 to 4 show what is known in prior art during wire line and coiled tubing operations. The wire line pressure control equipment 3 or coiled tubing pressure control equipment 4 is individually and separately hoisted into the tension frame by a lifting and lowering device (not shown) and connected to the top of the tree or surface flow valve.

Figure 5:
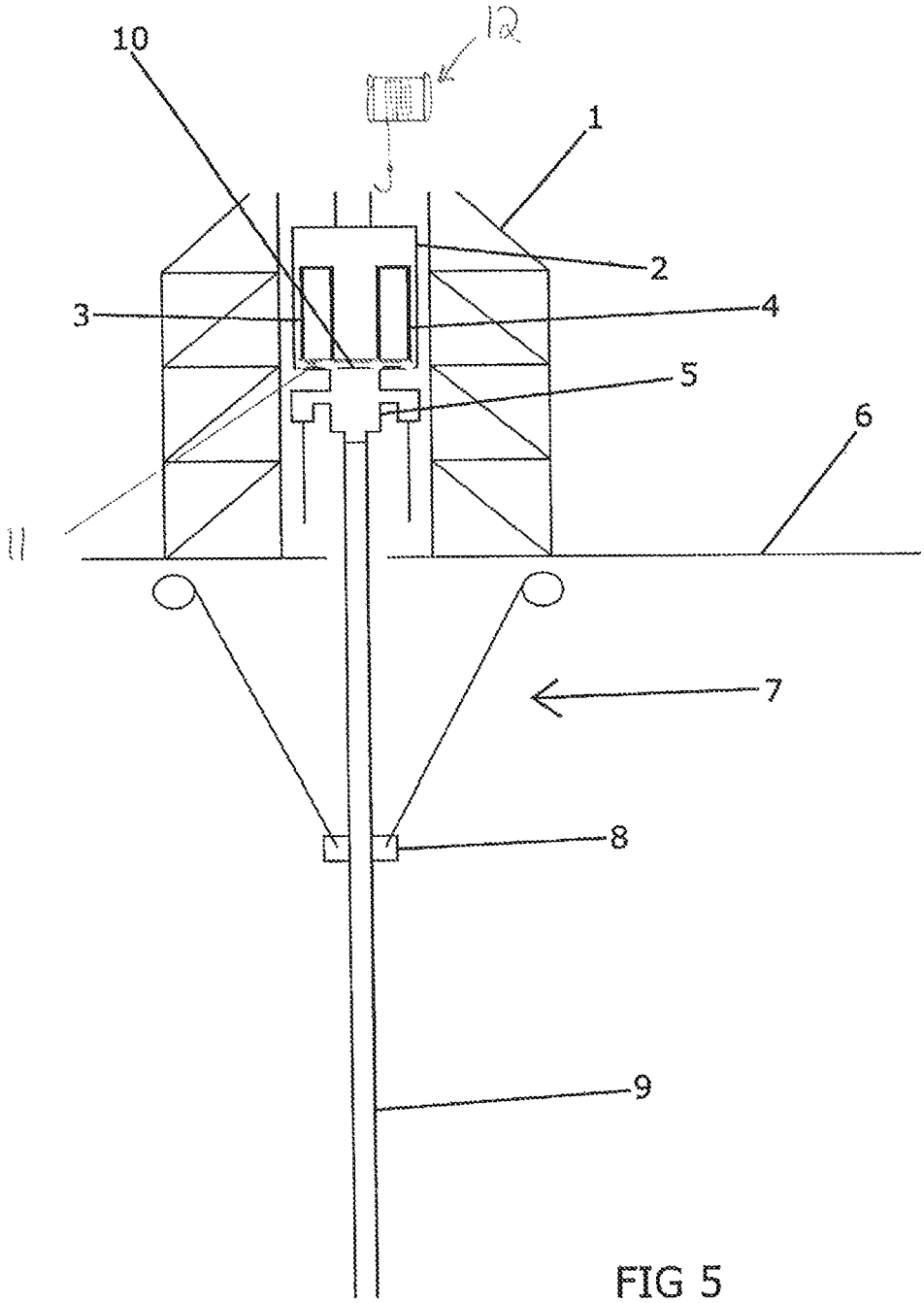
FIG. 5 is a front view of the tension frame according to the present invention having two pressure control equipment units housed within it in parked position.

FIG. 5 shows that the tension frame 2 according to the present invention is installed in the tower 1 with two pressure control equipment units 3, 4 installed within the frame, one unit 3 adapted for wire line operations and the other unit 4 adapted for coiled tubing operations 4. The two are parked one on each side of the riser center 10 atop the tree 5 in a ready-to-use state. The tension frame 2 is accessible by at least one of a skidding device 11 and a lifting and lowering device 12 that is adapted for shifting said wire line pressure control equipment unit 3 and said coiled tubing pressure control equipment unit 4 between the 7 active and the parked positions.

Figure 6:
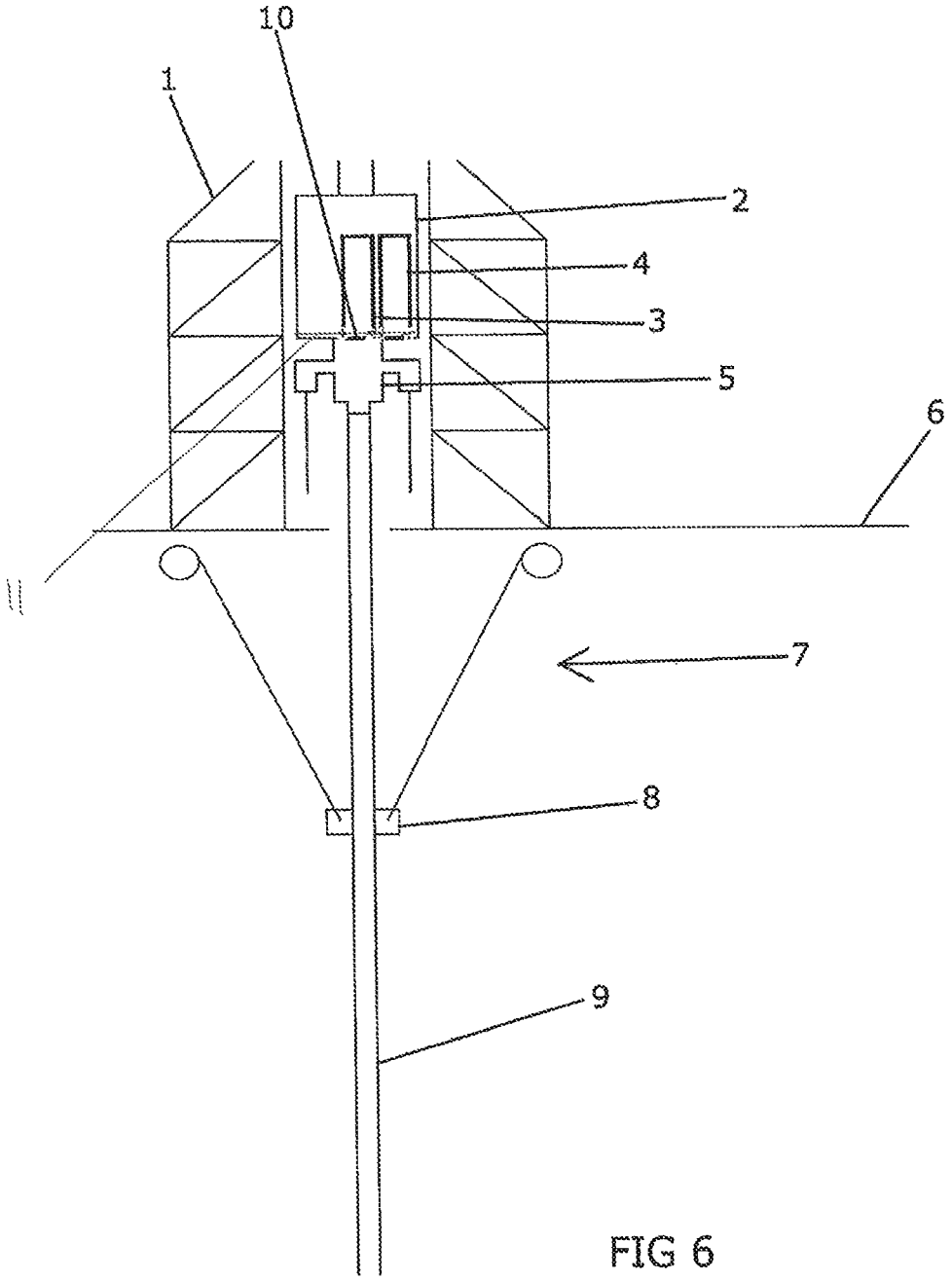
FIGS. 6 and 7 are front views of the tension frame according to the present invention of a riser system showing one of the two pressure control equipment units in activated position.

FIG. 6 shows a situation where the wire line pressure control equipment unit 3 has been moved within the tension frame 2 to a position in line with the rise center, while the coiled tubing pressure control equipment unit 4 is parked on one side in the tension frame 2.

Figure 7:
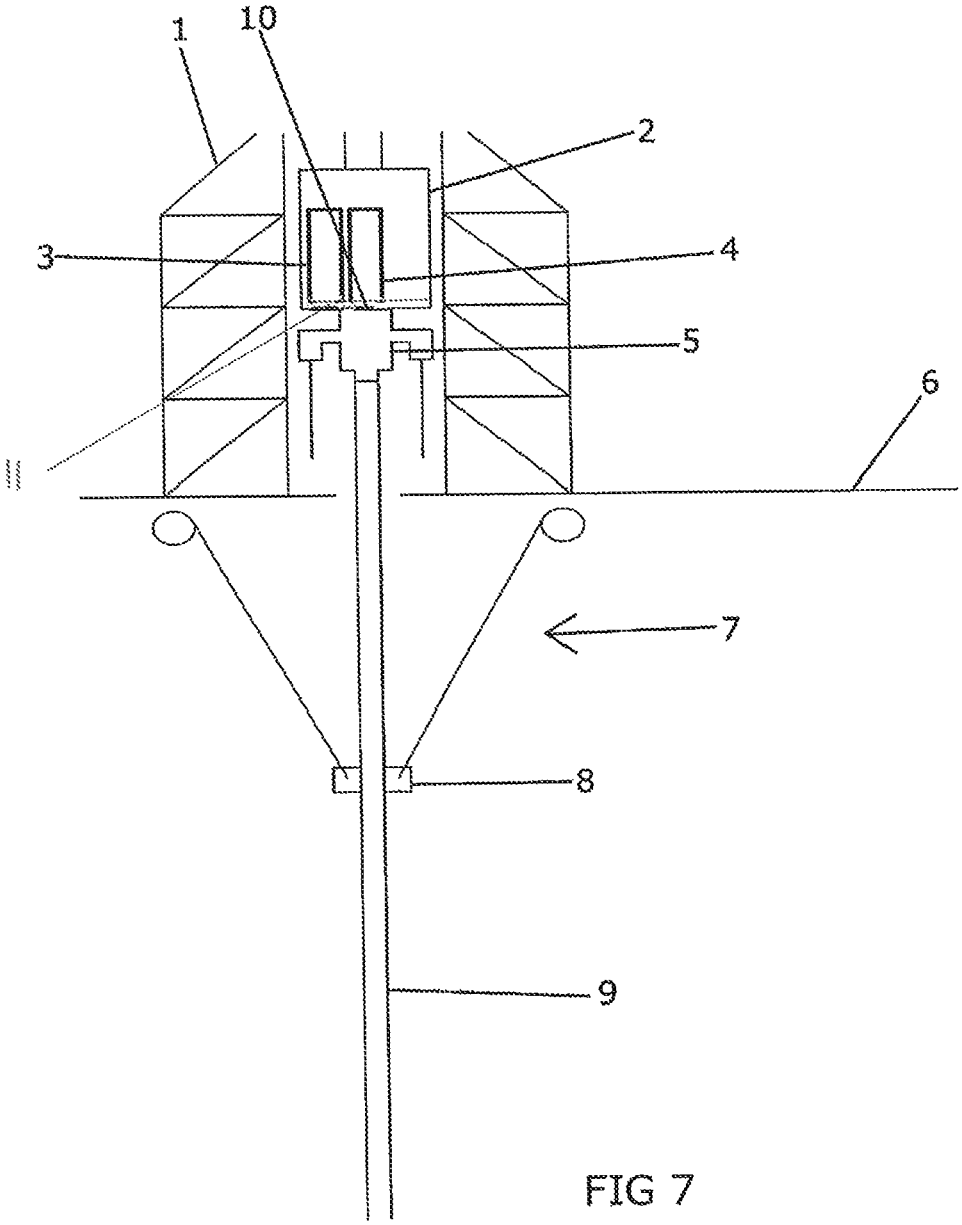

FIG. 7 shows a position where the coiled tubing pressure control equipment unit 4 has been moved within the tension frame 2 to a position in line with the rise center, while the wire line pressure control equipment unit 3 is parked on one side in the tension frame 2.

The tension frame can be accessed by a lifting and lowering device (not shown), which lifts up the wire line pressure control equipment 3 or the coiled tubing pressure control equipment 4 and move it sideways between the parked position in the frame 2 and the center position 10 on top of the tree 5. When one is installed at the center position 10, atop the tree 5, the other is parked on its side and vice versa. This should be clear from FIGS. 6 and 7. This is done depending upon whether it is a wire line operation or a coiled tubing operation.

The frame 2 may be a traditional two-dimensional frame with two legs or preferably be a three dimensional frame with four legs. The latter provides a working platform and hence better accessibility to workers.

The tension frame according to the present invention ensures faster and less risky operations and substantially reduces vertical relative motion between the tower and the riser with tension frame, by virtue of its pre-installed pressure control equipments housed within the frame.

For the sake of understanding, FIGS. 1 to 7 illustrate an exemplary riser system with which the tension frame 2 of the present invention is operatively associated with.

The tension frame 2, of the present invention is equally effective in achieving its objectives when operatively associated with other riser systems, as known to persons skilled in the art. Of course, the tension frame 2, housing two pre-installed pressure control equipments, when installed in the tower 1, is a part of a riser system.

The exemplary figures as described above show two pressure control equipment units for the sake of explanation. It should be understood that the scope of the present invention also intends to embraces more than two pressure control equipments housed within the tension frame, in ready to use state, as this in only limited by the size of the units and the space available within the frame.

The present invention has been described with reference to a preferred embodiment and some drawings for the sake of understanding only and it should be clear to persons skilled in the art that the present invention includes all legitimate modifications within the ambit of what has been described hereinbefore and claimed in the appended claims.

The invention claimed is:

1. A system for hydrocarbon exploration and production, the system comprising:

a tension frame installed on a well control unit atop at least one riser;

a pressure control unit received by the tension frame and held in line with a centre of the at least one riser;

said tension frame comprising a first pre-installed pressure control equipment unit and a second pre-installed pressure control unit of which the first pre-installed pressure control equipment unit is held in an active position, in which the first pre-installed pressure control unit is in line with the centre of the at least one riser, and the second pre-installed pressure control unit is kept in a parked position within the tension frame.

2. The system according to claim 1, wherein the first pre-installed pressure control unit and the second pre-installed pressure control unit comprise:

at least a wire line pressure control equipment unit;

a coiled tubing pressure control equipment unit; and wherein the wire line pressure control equipment unit and the coiled tubing pressure control equipment unit have a parking position within said tension frame on either side of the center of the at least one riser.

3. The system according to claim 2, wherein when said wire line pressure control equipment unit is held in said active position, said coiled tubing pressure control equipment unit is arranged to be in the parked position, on one side of said center of the at least one riser.

4. The system according to claim 2, wherein when said coiled tubing pressure control equipment unit is held in said active position, said wire line pressure control equipment unit is arranged to be in the parked position, on one side of said center of the at least one riser.

5. The system according to claim 3, wherein said tension frame is accessible by at least one of a skidding and a lifting and lowering device that shifts said wire line pressure control equipment unit and said coiled tubing pressure control equipment unit between the active position and the parked position.

6. The system according to claim 1, wherein said well control unit is at least one of a X-mas tree and a surface flow valve.

7. The system according to claim 1, wherein said tension frame is a two dimensional frame comprising at least two legs.

8. The system according to claim 1, wherein said tension frame is a three dimensional frame comprising at least four legs and a working platform.

* * * * *